United States Patent [19]

Scott

[11] Patent Number: 4,634,176

[45] Date of Patent: Jan. 6, 1987

[54] BACK SUPPORT ASSEMBLY FOR VEHICLE SEAT

[76] Inventor: Gregory M. Scott, 74 Walman St., Clifton, N.J. 07011

[21] Appl. No.: 656,665

[22] Filed: Oct. 1, 1984

[51] Int. Cl.[4] ..... A47C 7/02

[52] U.S. Cl. ..... 297/230; 297/284

[58] Field of Search ..... 297/230, 231, 284, 452, 297/353

[56] References Cited

U.S. PATENT DOCUMENTS

| | | | |
|---|---|---|---|
| 2,060,298 | 11/1936 | Gailey | 297/230 |
| 2,992,855 | 7/1961 | Mohler | 297/353 |
| 3,279,849 | 10/1966 | Radke et al. | 297/284 |
| 4,362,334 | 12/1982 | Ross et al. | 297/230 |
| 4,471,993 | 9/1984 | Watson | 297/230 |

FOREIGN PATENT DOCUMENTS

| | | | |
|---|---|---|---|
| 1163117 | 9/1969 | United Kingdom | 297/230 |

*Primary Examiner*—Francis K. Zugel
*Assistant Examiner*—Jose V. Chen
*Attorney, Agent, or Firm*—Louis E. Marn

[57] ABSTRACT

A back support assembly for a vehicular seat including a back support frame removably secured, in a generally vertical position, to a front surface of a back member of a vehicular seat; and a back support carriage interconnected to the back support frame in a manner that limits lateral displacement of the carriage, but permits vertical displacement of the carriage so as to maintain continuous, large area contact with a motorist's lower back.

4 Claims, 3 Drawing Figures

BACK SUPPORT ASSEMBLY FOR VEHICLE SEAT

FIELD OF INVENTION

The invention relates to a back support assembly to be disposed on the back member of a vehicular seat, and more particularly to back support assembly including a back support carriage that is freely movable in a generally vertical direction.

BACKGROUND OF THE INVENTION

Back supports including pliant members adapted to be positioned across the front of a back member of an automobile seat to support the dorso-lumbar curve of the spine of a motorist are priorly known, for example, from U.S. Pat. No. 2,831,533, issued Apr. 22, 1958. Such back supports are generally directed toward adding rigidity to the spine by the application of a convex support surface thereto. In the employment of such prior art back supports, the fulcrum about which the upper legs turn, as the automobile bounces up and down, is in the area of the dorso lumbar curve. A forceful straightening of the dorso-lumbar curve, as viewed by some medical authorities, often percipitates pain in the lower back and legs. In accordance with these authorities, the proper forward curve of the spine, or lumbar lordosis, lessens the intradical pressure, i.e. the tendency for a disc of the spinal column to bulge and press against a nerve.

The prior art back supports are designed to relieve discomfort associated with bone and disc structures of the motorist's spinal column, while the present invention is based upon the view that driving discomfort is largely a problem associated with soft tissues (muscles and ligaments of the lower back). More particularly, that the motorist's discomfort is caused by the compressive and distractive forces applied to such soft tissues when an automobile bounces up and down during an extended driving period. To minimize such forces, the present invention includes a back support carriage freely movable in a generally vertical direction so as to maintain continuous, large area contact with the motorist's back, even when the automobile is bouncing up and down. As a result of such continuous, large area contact, the back of the motorist moves as a supported, substantially rigid unit; the fulcrum about which the upper legs turn as the automobile bounces up and down is in the area of the posterior; and a major portion of the compressive and distractive forces resulting from the automobile bouncing up and down, are absorbed by muscles and ligaments of the motorist's buttocks and legs.

OBJECTS OF THE INVENTION

An object of the present invention is to provide a novel back support assembly to be disposed on the back member of a vehicular seat, including a back support carriage freely movable in a vertical direction.

Another object of the present invention is to provide a novel back support assembly, including a back support carriage adapted to maintain continuous, large area contact with a motorist's lower back.

Still another object of the present invention is to provide a novel back support assembly that enables the lower back of a motorist to move as a supported complete unit.

A further object of the present invention is to provide a novel back support assembly that minimizes compressive and distractive forces applied to the soft tissues of a motorist's lower back.

A still further object of the present invention is to provide a novel back support assembly including a back support carriage that moves with the motorist's lower back as a supported, complete unit; and the fulcrum about which the motorist's upper legs turn, because of automobile up and down bouncing, lies in the area of the posterior of the spinal column.

SUMMARY OF THE INVENTION

These and other objects of the present invention are achieved by a back support assembly including a back support frame removably secured, in a generally vertical position, to a front surface of a back member of a vehicular seat, and a back support carriage interconnected to the back support frame in a manner that limits lateral displacement of the carriage, but permits free vertical displacement of the carriage, as more fully hereinafter described.

BRIEF DESCRIPTION OF THE DRAWING

A better understanding of the present invention as well as other objects and advantages thereof will become apparent upon consideration of the detailed disclosure thereof, especially when taken with the accompanying drawing, wherein.

DETAILED DESCRIPTION OF THE DRAWING

Figure 1:
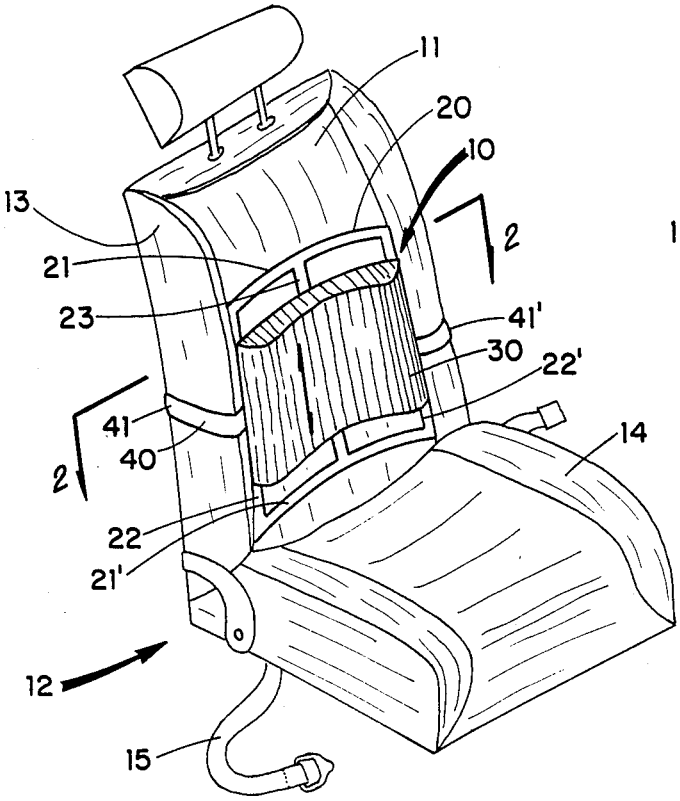
FIG. 1 is a perspective view of a back support assembly in accordance with the present invention, mounted on a back member of a vehicular seat.

Referring now to the drawing, there is illustrated a back support assembly, generally indicated as 10, including a back support track frame 20, a back support carriage 30, and a back support belt attachment 40 for maintaining the back support assembly 10 in a generally vertical position on the front surface 11 of a vertical back rest 13 of a vehicle seat 12.

The back support track frame 20 includes an upper elongated member 21, lower elongated member 21', two elongated track side members 22 and 22' and an elongated track center member 23, which are fixedly attached to each other in a generally flat, rectangular configuration having a major face that may be fitted closely against the front surface 11 of the back rest 13. The back support belt attachment 40 comprises a pair of belt sections 41 and 41'. The belt section 41 has one end thereof fixedly attached to the elongated track side member 22, while the belt section 41' has one end thereof fixedly attached to the elongated track side member 22'. The other ends of belt sections 41 and 41' have secured thereto, on opposite adjacent surfaces, respectively, VELCRO® fastening strips 42 and 42'. Preferably, the back support frame 20 is positioned at the lowest permissible vertical position on the front surface 11 of the back rest 13 (i.e. the horizontal position whereat the lower elongated member 21' is closely fitted against a horizontal support member 14 of the vehicle seat 13, when such support member 14 is in a completely compressed condition), and the belt sections 41 and 41′ extend tightly about the vertical back rest 13 in a manner establishing an elongated attachment between the VELCRO® fastening stips 42 and 42′. Though the embodiment disclosed herein references the use of VELCRO® fastening strips, other suitable fastening means may be used by one skilled in the art without departing from the scope of the present invention.

Figure 2:
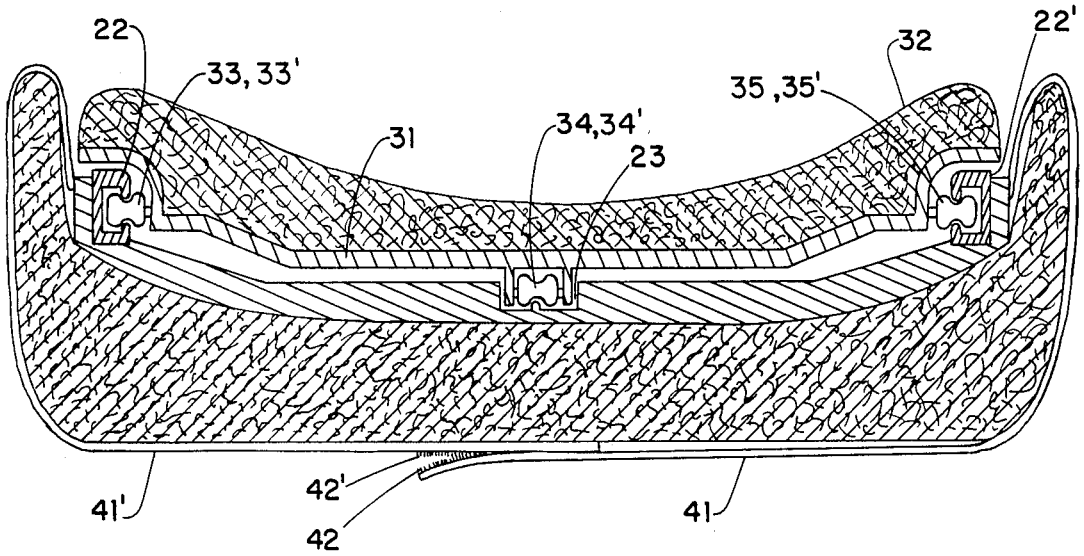
FIG. 2 is a top plan view of the back support assembly mounted on the back member of the vehicular seat illustrated in FIG. 1, taken along the line 2—2.

The back support carriage 30 includes a rigid carriage frame 31 having a generally rectangular major face, the width of which approximates the width of the back support track frame 20. Fixedly attached to the carriage frame 31 is a pliant back support 32 having a generally rectangular major face that complements and is attached to a major front surface of the carriage frame 31. The rigid carriage frame 31 and the pliant back support 32 have contoured cross sections in the horizontal plane, as illustrated in FIG. 2, and substantial heights, for example in the order of twelve inches, for continuously maintaining large area contact with a motorist's lower back, in a manner providing both lateral and vertical support. Further, fixedly attached to the carriage frame 31 are vertically-disposed roller attachments 33 and 33′; 34 and 34; and 35 and 35′. The roller attachments 33 and 35 are affixed to an upper portion of opposite sides of the carriage frame 31, and are partially positioned, respectively, in the elongated track side members 22 and 22′; while the roller attachments 33′ and 35′ are affixed to a lower portion of the opposite sides of the carriage frame 31 and are also partially positioned, respectively, in the elongated track side members 22 and 22′. The roller attachments 34 and 34′ are affixed to a back face of the carriage frame 31, at an upper and lower portion, respectively, and are each partially positioned within the elongated track center member 23.

A description of the manner in which the back support assembly 10 is employed will assist in the understanding of the purpose and intercooperation of the various features of the instant invention. The back support assembly 10 is positioned on the front face 11 of the vertical back rest 13, with the lower elongated member 21′ of the back support track frame 20 positioned at a level approximately at the level of an upper surface of a fully depressed, horizontal support member 14 of the vehicle seat 12. By means of the back support belt attachment 40, the back support, track frame 20 is removably secured to the vertical back rest 13. As the result of the intercooperation between the various roller attachments 33, 34 and 35 and 33′, 34′ and 35′ of the back supprt carriage 30, and the elongated track, side members 22 and 22′ and the elongated track, center member 23 of the back support, track frame 20, there is enabled free vertical movement of the back support carriage 30 with respect to the back support, track frame 20, but highly restricted lateral movement therebetween.

Figure 3:
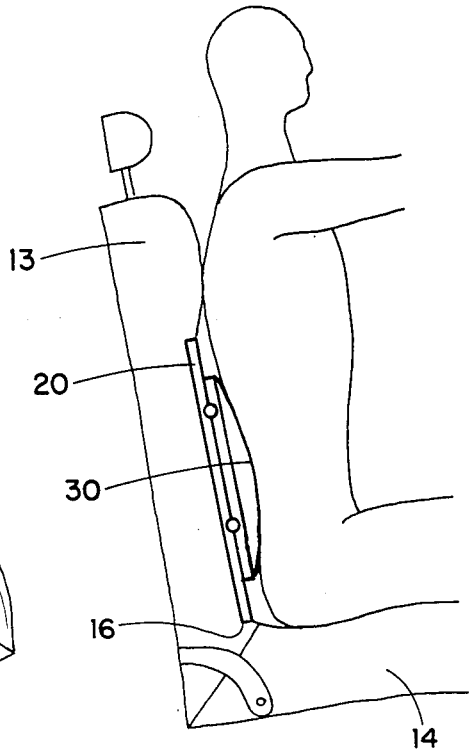
FIG. 3 is a side elevational view, partially cut away, of the back support assembly and vehicular seat illustrated in FIG. 1, and shown supporting a motorist.

A motorist sitting in the vehicle seat 12 employs a seat belt 15 in the usual manner, and is positioned as illustrated in FIG. 3. The vertical position of the back support carriage 30 is determined by the engagement of its lower end with a top face 16 of the horizontal support member 14 of the vehicle seat 12. Alternatively, a spring biasing means, not shown, may be included to provide a rest position of the back support carriage 30 above the level of the lower elongated member 21 of the back support, track frame 20. Upon the vehicle seat 12 bouncing up and down as the automobile is driven, the motorist's lower back remains in continuous large area contact with the back support carriage 30 since such carriage is free to move up or down on the roller attachments 33, 34 and 35 and 33′, 34′ and 35′ in a generally vertical direction. As such up and down movement is highly restricted in the lateral direction by the elongated track side members 22 and 22′, and the elongated center member 23, the back support carriage 30 retains the up and down movements of the motorist's lower back in a fixed axial direction which minimizes the distractive forces applied to the soft tissues of the motorist's lower back. Further, the height of the back support carriage 30 (e.g., in the range of 9 to 14 inches) is greater than the distance between the motorist's buttocks and the upper limit of the motorist's dorso-lumbar curve. By positioning and maintaining the lower portion of the back support carriage 30 at the level of the motorist's buttocks, the motorist's lower back moves with the back support carriage 30 as a continuously, laterally and vertically supported unit, and the fulcrum about which the motorist's upper legs turn during such up and down movements of the vehicle seat 12 is in the area of the posterior. As a result of the dynamics of the aforesaid, the major portion of the compressive and distractive forces resulting from the automobile bouncing up and down, are absorbed by the muscles and ligaments of the motorist's buttocks and legs.

While the invention has been described in connection with an exemplary embodiment thereof, it will be understood that many modifications will be apparent to those of ordinary skill in the art and that this application is intended to cover any adaptations or variations thereof. Therefore, it is manifestly intended that this invention be only limited to the claims and the equivalents thereof.

What is claimed:

1. A back support assembly for a vehicular seat, which comprises:

a back support frame including a plurality of vertically-disposed, elongated track members, two of which are disposed along the sides of said frame, and two track members generally C-shaped in cross-section and facing inwardly toward each other and elongated cross member means fixedly attached to each other in a generally flat rectangular configuration having a major face that may be fitted closely against a front surface of a back rest of a vehicle seat;

a back support attachment for securing said back support frame, in a generally vertical position, to said front surface of said back rest; and a back support carriage including a rigid carriage frame having a generally rectangular major face the width of which approximates the width of said back support frame, a first plurality of roller attachments affixed along an upper portion of said rigid carriage frame, a second plurality of roller attachments affixed along a lower portion of said rigid carriage frame, each of said first and second plurality of roller attachments including a roller partially positioned within one of said plurality of vertically-disposed, elongated track members of said back support frame for interconnecting said back support carriage to said back support frame for avoiding lateral displacement of said back support carriage with respect to said back support frame, while permitting free vertical movement of said back support carriage with respect to said back support frame, said back support carriage further including a pliant back support member having a concave cross-section in a horizontal plane for maintaining large are vertical and horizontal support to the lower back of a motorist.

2. A back support assembly in accordance with claim 1 wherein said pliant back support member of said back support carriage is of a vertical height within the range of 9 to 14 inches.

3. A back support assembly in accordance with claim 1 wherein said pliant back support member has a generally rectangular major face that complements and is fixedly attached to a major front surface of said rigid carriage frame, said rigid carriage frame and said back support member having contoured cross sections in the horizontal plane and each being of a height in the range of 9 to 14 inches.

4. A back support assembly in accordance with claim 3 wherein said plurality of elongated track members of said back support frame are of a length in excess of said height of said rigid carriage frame for permitting vertical up and down displacement of said back support carriage.

* * * * *